US009230481B2

(12) United States Patent
Tseng et al.

(10) Patent No.: US 9,230,481 B2
(45) Date of Patent: Jan. 5, 2016

(54) PIXEL CIRCUIT AND DRIVING METHOD AND DISPLAY DEVICE THEREOF

(71) Applicant: InnoLux Corporation, Miao-Li County (TW)

(72) Inventors: Ming-Chun Tseng, Miao-Li County (TW); Yi-Hua Hsu, Miao-Li County (TW)

(73) Assignee: INNOLUX CORPORATION, Taiwan (TW)

( * ) Notice: Subject to any disclaimer, the term of this patent is extended or adjusted under 35 U.S.C. 154(b) by 114 days.

(21) Appl. No.: 14/044,993

(22) Filed: Oct. 3, 2013

(65) Prior Publication Data

US 2014/0292740 A1 Oct. 2, 2014

(30) Foreign Application Priority Data

Mar. 28, 2013 (TW) ..... 102111099 A

(51) Int. Cl.
*G09G 3/32* (2006.01)

(52) U.S. Cl.
CPC ..... *G09G 3/3258* (2013.01)

(58) Field of Classification Search
CPC ..... G09G 3/3233; G09G 2300/0852; G09G 3/3258; G09G 3/3208; G09G 3/3291
See application file for complete search history.

(56) References Cited

U.S. PATENT DOCUMENTS

| | | | | |
|---|---|---|---|---|
| 2005/0052377 | A1* | 3/2005 | Hsueh | G09G 3/3233 345/82 |
| 2005/0156829 | A1* | 7/2005 | Choi | G09G 3/3233 345/76 |
| 2005/0285825 | A1* | 12/2005 | Eom | G09G 3/3233 345/76 |
| 2006/0028408 | A1* | 2/2006 | Kim | 345/76 |
| 2006/0176250 | A1* | 8/2006 | Nathan et al. | 345/76 |
| 2007/0120795 | A1* | 5/2007 | Uchino et al. | 345/92 |
| 2008/0001861 | A1* | 1/2008 | Asano et al. | 345/77 |
| 2008/0043005 | A1* | 2/2008 | Kanda | G09G 3/3233 345/204 |
| 2009/0219232 | A1* | 9/2009 | Choi | G09G 3/3233 345/76 |

* cited by examiner

*Primary Examiner* — Lun-Yi Lao
*Assistant Examiner* — Elliott Deaderick
(74) *Attorney, Agent, or Firm* — Bacon & Thomas, PLLC

(57) ABSTRACT

A pixel circuit includes an OLED, a driving transistor, first and second transistors, a storage capacitor and a coupling capacitor. The OLED includes an anode and a cathode connected to a first voltage source. The driving transistor includes a first node connected to a second voltage source, a second node, and a third node connected to the anode. The first transistor includes first, second and third terminals connected to a data driving line, a first control signal source, and the second node, respectively. The second transistor includes a first terminal, a second terminal connected to a second control signal source, and a third terminal connected to the anode and the third node. The storage capacitor includes first and second terminals connected to a third voltage source and the second transistor, respectively. The coupling capacitor includes first and second terminals connected to the second transistor and the second node, respectively.

11 Claims, 10 Drawing Sheets

PIXEL CIRCUIT AND DRIVING METHOD AND DISPLAY DEVICE THEREOF

BACKGROUND OF THE INVENTION

1. Field of the Invention

The present invention relates to a pixel circuit and its driving method and, more particularly, to an active matrix OLED pixel circuit and its driving method suitable for compensating transistor threshold voltage and OLED voltage.

2. Description of Related Art

Driving transistors of active matrix OLED (AMOLED) can be classified to P-type transistors and N-type transistors according to its back plate manufacture technologies. Please refer to FIG. 1 and FIG. 2, which are prior P-type and N-type driving circuits of AMOLED, respectively. As shown in FIG. 2, for the N-type driving circuit, there is a problem in that the threshold voltage of the N-type transistor may be shifted. This threshold voltage shift is caused by the generation of degradation due to the manufacture variation and long-time operation, resulting in being unable to output a current same as the initial current and thus producing mura or brightness decay. Moreover, due to that the OLED is operated for a long time, the operating voltage is increased following the increase of the time. Thus, to solve the aforementioned problem, an N-type compensation circuit is proposed. With reference to both FIG. 3 and FIG. 4, there are a schematic diagram of N-type AMOLED compensation driving circuit and a timing diagram of N-type compensation driving circuit. As shown in FIG. 3 and FIG. 4, it can be seen that the number of components (6T2C) in the pixel circuit design is too many and the driving signals (Sn, Sn', En, Xen) become too complicated, resulting in being unable to satisfy the requirements of high precision and high aspect ratio.

Therefore, it is desirable to provide an improved pixel circuit and its driving method, in which N-type driving transistors are used to drive the OLED, and combined with a plurality of transistors and capacitors to compensate the threshold voltage of the N-type transistor and the voltage of the AMOLED, so as to satisfy the requirements of high precision and high aspect ratio.

SUMMARY OF THE INVENTION

The invention provides a pixel circuit, which comprises: an OLED including an anode, and a cathode connected to a first voltage source; a driving transistor for driving the OLED including a first node connected to a second voltage source, a second node, and a third node connected to the anode; a first transistor including a first terminal connected to a data driving line, a second terminal connected to a first control signal source, and a third terminal connected to the second node; a second transistor including a first terminal, a second terminal connected to a second control signal source, and a third terminal connected to the anode and the third node; a storage capacitor including a first terminal connected to a third voltage source and a second terminal connected to the first terminal of the second transistor; and a coupling capacitor including a first terminal connected to the first terminal of the second transistor and a second terminal connected to the second node.

In addition, in a reset stage, the first control signal source provides a first control signal to turn the first transistor on, and the data driving line inputs a reference voltage to the driving transistor to reset the second node, the third node, and the first terminal of the coupling capacitor; in a compensating stage, the second node and the storage capacitor store a threshold voltage of the driving transistor, and the driving transistor is transited from on state to off state; in a programming stage, the second control signal source provides a second control signal to turn off the second transistor, the data driving line inputs a data voltage to the driving transistor, and a voltage of the coupling capacitor is coupled to the first terminal of the coupling capacitor; in a light emitting stage, the threshold voltage and a voltage of the OLED are coupled to the second node.

Moreover, the driving transistor, first transistor and second transistor are N-type transistors.

Besides, the pixel circuit comprises a third transistor including a first terminal connected to a forth voltage source, a second terminal connected to a third control signal source, and a third terminal connected to the second node, the forth voltage source provides a reference voltage, the third transistor is turned on according to a third control signal so as to input the reference voltage to the second node.

Furthermore, the invention provides a method for driving a pixel circuit, wherein the pixel circuit comprises an OLED including an anode and a cathode connected to a first voltage source; a driving transistor for driving the OLED, the driving transistor including a first node connected to a second voltage source, a second node and a third node connected to the anode; a first transistor including a first terminal connected to a data driving line, a second terminal connected to a first control signal source and a third terminal connected to the second node; a second transistor including a first terminal, a second terminal connected to a second control signal source and a third terminal connected to the anode and the third node; a storage capacitor including a first terminal connected to a third voltage source and a second terminal connected to the first terminal of the second transistor; and a coupling capacitor including a first terminal connected to the first terminal of the second transistor and a second terminal connected to the second node. The method comprises the steps of: (A) in a reset stage, using the first control signal to turn on the first transistor, and inputting a reference voltage to the driving transistor for resetting the second node, the third node and the first terminal of the coupling capacitor; (B) in a compensating stage, storing a threshold voltage of the driving transistor to the third node and the storage capacitor, and the driving transistor being transited from on state to off state; (C) in a programming stage, using the second control signal to turn off the second transistor, inputting a data voltage to the driving transistor, and coupling a voltage of the coupling capacitor to the first terminal of the coupling capacitor; and (D) in a light emitting stage, coupling the threshold voltage and a voltage of the OLED to the second node.

In addition, the invention provides a display panel, which comprises: a plurality of pixel circuits arranged as a pixel circuit matrix according a plurality of columns and rows; a data driver having a plurality of data driving lines connected to the pixel circuits on the columns of the pixel circuit matrix for providing at least an input voltage; a scan driver having a plurality of scan driving lines vertically intersected with the data driving lines for being connected to the pixel circuits on the rows of the pixel circuit matrix for providing at least a switching voltage; a voltage generator having a plurality of voltage supply lines respectively arranged between the scan driving lines for being connected to the pixel circuits to supply at least a voltage source; a timing controller connected to the data driver, the scan driver, and the voltage generator for controlling the data driver, the scan driver, and the voltage generator.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
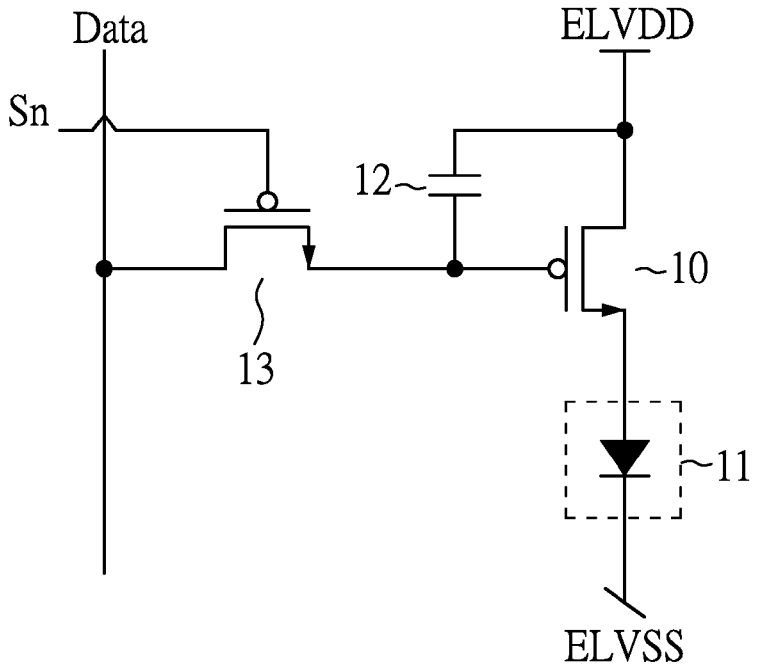
FIG. 1 (PRIOR ART)
FIG. 1 is a schematic diagram of a prior P-type driving circuit of an AMOLED.
Figure 2:
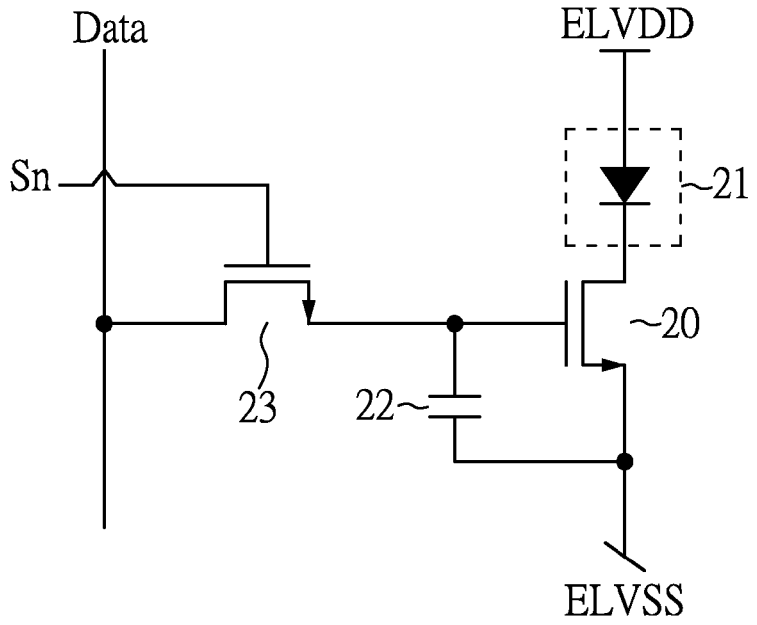
FIG. 2 (PRIOR ART)
FIG. 2 is a schematic diagram of a prior N-type driving circuit of an AMOLED.
Figure 3:
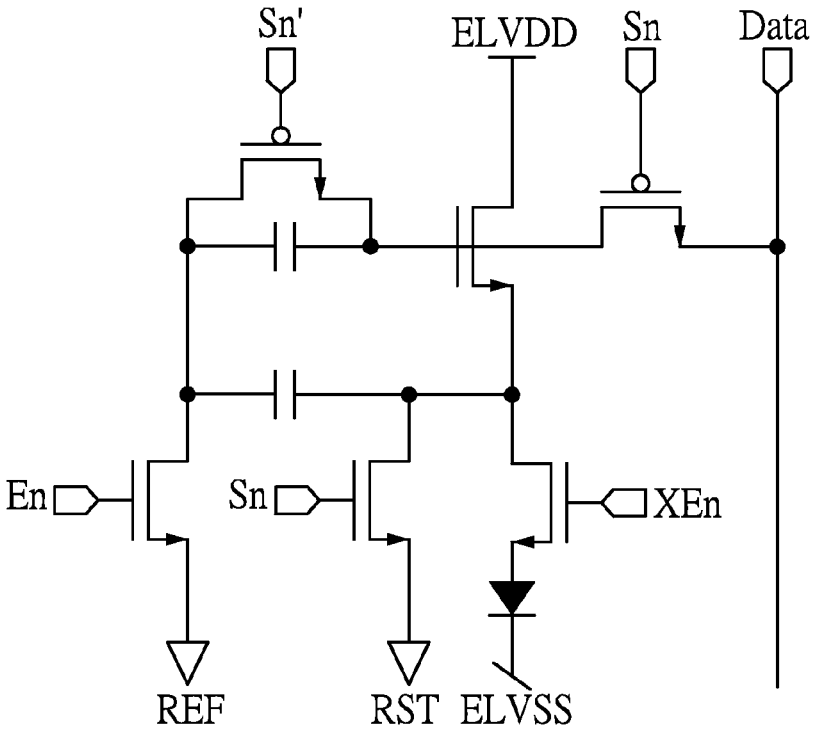
FIG. 3(PRIOR ART)
FIG. 3 is a schematic diagram of a prior N-type compensation driving circuit of an AMOLED.
Figure 4:
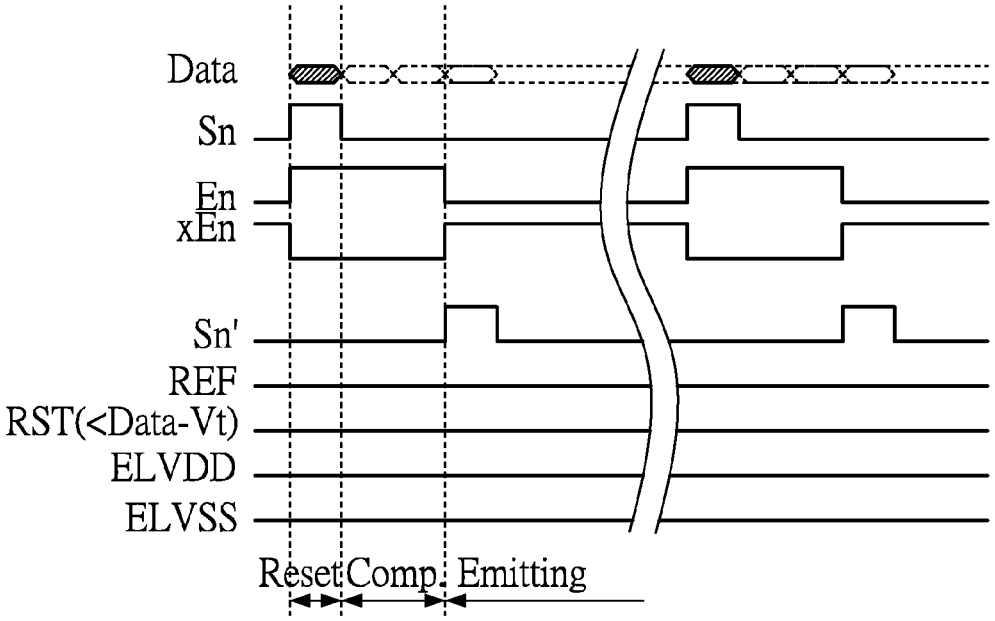
FIG. 4 (PRIOR ART)
FIG. 4 is a timing diagram of the compensation driving circuit shown in FIG. 3.
Figure 5:
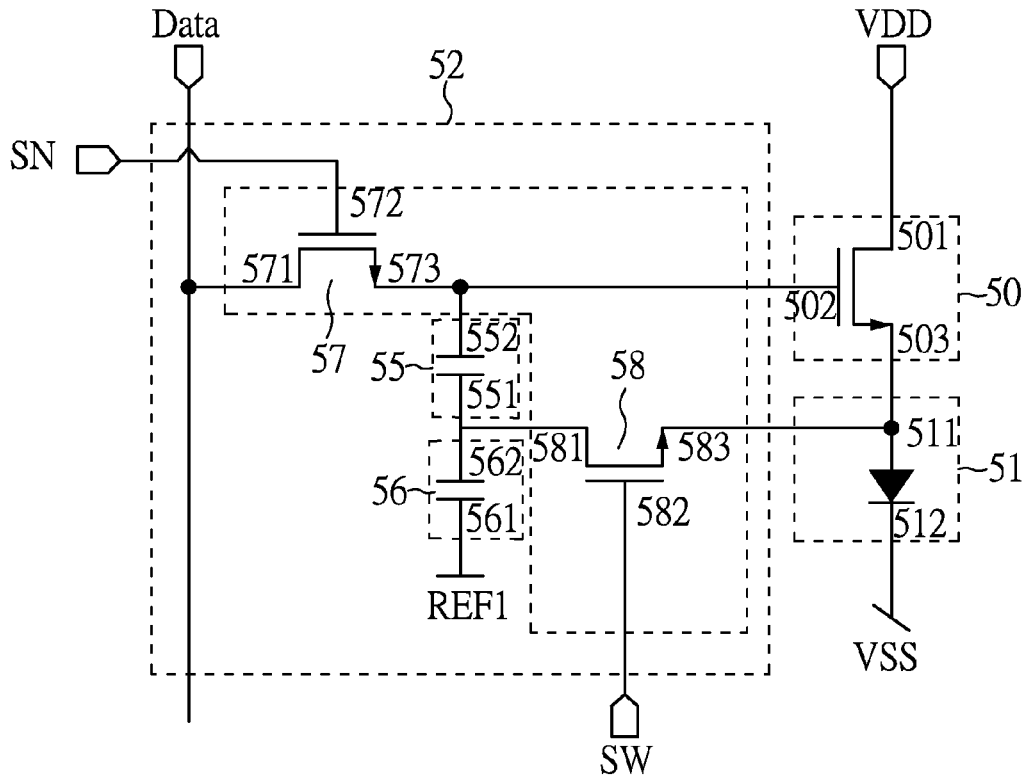
FIG. 5 is a schematic diagram of the pixel circuit in accordance with a preferred embodiment of the invention.

With reference to FIG. 5, there is shown a schematic diagram of a pixel circuit in accordance with a preferred embodiment of the invention. As shown, the pixel circuit includes: a driving transistor 50, an OLED 51, and a voltage control unit 52. The OLED 51 includes an anode 511 and a cathode 512, wherein the cathode 512 is connected to a first voltage source VSS that provides a first voltage Vss. The driving transistor 50 is preferred to be an N-type transistor including a first node 501, a second node 502 and a third node 503, wherein the first node 501 is a drain electrically connected to a second voltage source VDD that provides a second voltage Vdd, the second node 502 is a gate, and the third node 503 is a source electrically connected to the anode 511.

The aforementioned voltage control unit 52 includes a first transistor 57, a second transistor 58, a storage capacitor 56 and a coupling capacitor 55. The first transistor 57 has a first terminal 571 connected to a data driving line DATA, a second terminal 572 connected to a first control signal source SW that provides a first control signal, and a third terminal 573 connected to the second node 502. The second transistor 58 has a first terminal 581, a second terminal 582 connected to a second control signal source SW that provides a second control signal, and a third terminal 583 connected to the anode 511 and the third node 503. The first and second transistors 57, 58 are preferred to be N-type transistors. The storage capacitor 56 has a first terminal 561 connected to a third voltage source REF1, and a second terminal 562 connected to the first terminal 581 of the second transistor 58. The coupling capacitor 55 has a first terminal 551 connected to the first terminal 581 of the second transistor 58, and a second terminal 552 connected to the second node 502. Accordingly, when the pixel circuit is in a reset stage, the first transistor 57 is turned on by the first control signal, and a reference voltage Vref is inputted to the driving transistor 50 to reset the second node 502, the third node 503 and the first terminal 581 of the second transistor 58. When the pixel circuit is in a compensation stage, a threshold voltage Vt of the driving transistor 50 is stored into the third node 503 and the storage capacitor 56, and then the driving transistor 50 is transited from on state to off state. When the pixel circuit is in a programming stage, the second transistor 58 is turned off by the second control signal, a data voltage is inputted to the driving transistor 50, and a voltage of the coupling capacitor 55 is coupled to the first terminal 581 of the second transistor 58. When the pixel circuit is in a light emitting stage, the threshold voltage Vt and a voltage Voled of the OLED 51 are coupled to the second node 502. The aforementioned reset stage, compensation stage, programming stage and light emitting stage are executed repeatedly in sequence.

Figure 6:
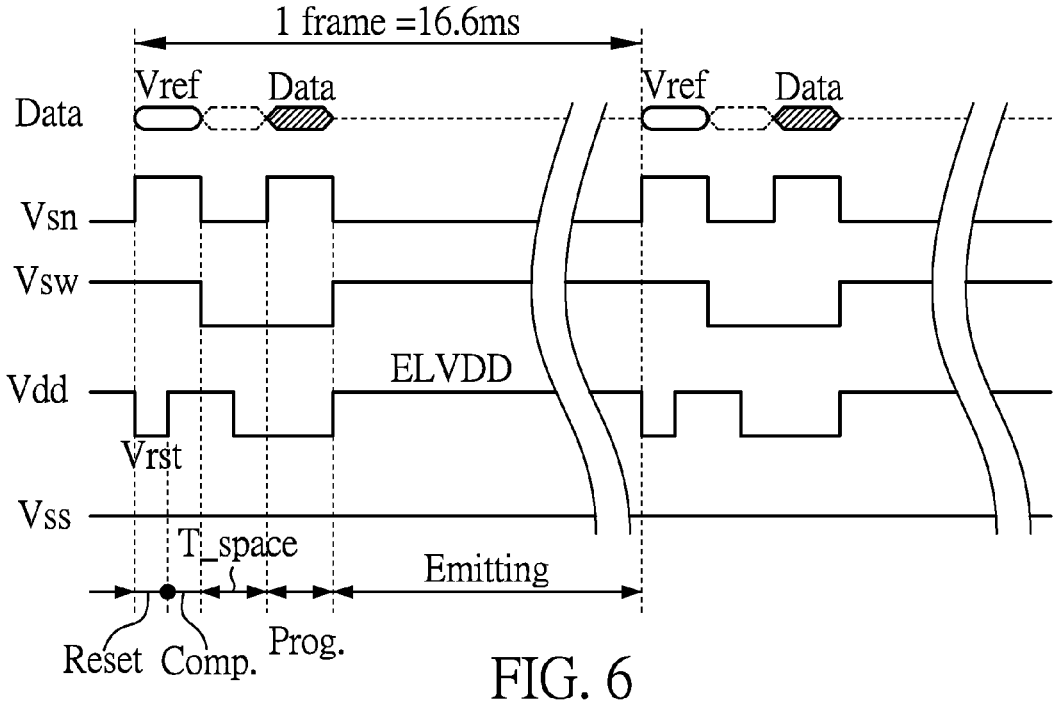
FIG. 6 is a timing diagram of the pixel circuit shown in FIG. 5.

With reference to FIG. 6, which is a timing diagram of the pixel circuit shown in FIG. 5, the circuit operation can be divided into the reset stage (Reset), compensation stage (Comp.), programing stage (Prog.) and light emitting stage (Emitting). The on/off states of the driving transistor 50, the first transistor 51, the second transistor 58 and the OLED 51 corresponding those stages are illustrated in Tablet, and a voltage (VG) of the second node 502 of the driving transistor 50, a voltage (Vs) of the anode 511 of the OLED 51, a voltage (VN) of the first terminal 551 of the coupling capacitor 55, a voltage difference (VGS) between the second node 502 and the anode 511, and a voltage difference (VGN) between the second node 502 and the first terminal 551 of the coupling capacitor 55 are illustrated in Table 2.

TABLE 1

| Cycle | Driving transistor | First transistor | Second transistor | OLED |
|---|---|---|---|---|
| Reset stage | ON | ON | ON | OFF |
| Comp. stage | OFF | ON | ON | OFF |
| Prog. stage | ON | ON | OFF | OFF |
| Emitting stage | ON | OFF | ON | ON |

TABLE 2

| | Reset stage | Comp. stage | Prog. stage | Emitting stage |
|---|---|---|---|---|
| Second node of the driving transistor ($V_G$) | Vref | Vref | Vdata | (Vdata − Vref) * (1 − f1) + Vt + Voled |
| Anode of the OLED ($V_S$) | Vrst | Vref − Vt | Vrst | Voled |
| First terminal of the coupling capacitor ($V_N$) | Vrst | Vref − Vt | Vref * (1 − f1) + Vdata * f1 − Vt | Voled |
| Voltage difference between the | Vref − Vrst | Vt | Vdata − Vrst | (Vdata − Vref) * (1 − f1) + Vt |

TABLE 2-continued

| | Reset stage | Comp. stage | Prog. stage | Emitting stage |
|---|---|---|---|---|
| second node and the anode ($V_{GS}$) | | | | |
| Second node and the first terminal of the coupling capacitor ($V_{GN}$) | Vref − Vrst | Vt | (Vdata − Vref) * (1 − f1) + Vt | (Vdata − Vref) * (1 − f1) + Vt |

As a result, in the reset stage, the driving transistor 50, first transistor 57, and second transistor 58 are in on state, and the OLED 50 is in off state. The data driving line (Data) inputs a reference voltage Vref to the first terminal 571 of the first transistor 57, and then to the third terminal 573 of the first transistor 57 so as to reset the second node 502 to be the reference voltage Vref, and the second voltage Vdd is a reset voltage Vrst at the same time, satisfying the relation of Vref>Vrst+Vt, such that the third node 503 is reset to be the reset voltage Vrst, and thus the first terminal 551 of the coupling capacitor 55 is reset to be the reset voltage Vrst.

In the compensation stage, the first transistor 57 and the second transistor 58 are in on state, and the OLED 51 is in off state. The second node 502 is still the reference voltage Vref, and the second voltage Vdd is transited to a high potential voltage ELVDD at the same time, such that the driving transistor 50 is turned gradually from on to off by discharging, and the anode 511 of the OLED 51 is discharged to Vref−Vt, so as to measure the threshold voltage Vt of the driving transistor 50 and then store it into the storage capacitor 56.

As shown in FIG. 6, after the compensation stage, there is a space time (T_space), which is a period of time between the compensation stage and the programing stage, and the space time is greater than or equal to 0.

In the programing stage, the driving transistor 50 and the first transistor 57 are in on state, and the second transistor 58 and the OLED 51 are in off state. The data driving line (Data) inputs a data voltage Vdata to the first terminal 571 of the first transistor 57, and then to the third terminal 573 of the first transistor 57 so as to allow the second node 502 to be the data voltage Vdata, and the second voltage Vdd is the reset voltage Vrst at the same time, such that the voltage VN of the first terminal 511 of the coupling capacitor 55 is coupled, via the coupling capacitor 55, to:

$$V_N = Vref - Vt + (Vdata - Vref) * f1 = Vref * (1 - f1) + Vdata * f1 - Vt, \quad (1)$$

and the voltage difference between the second node 502 and the first terminal 511 of the coupling capacitor 55 is:

$$V_{GN} = Vdata - (Vref(1 - f1) + Vdata * f1 - Vt) = (Vdata - Vref) * (1 - f1) + Vt, \quad (2)$$

wherein f1=Ccp/(Ccp+Cst), Ccp is capacitance value of the coupling capacitor 55, and Cst is capacitance value of the storage capacitor 56. The storage capacitor 56 has both the threshold voltage Vt and data voltage Vdata in the previous stage, such that the voltage difference $V_{GN}$ between the second node 502 and the first terminal 551 of the coupling capacitor 55 is greater than or equal to the threshold voltage Vt. Meanwhile, the OLED 51 cannot be turned on, and thus the following conditions have to be satisfied:

$$Vrst \leq Vss + Voled(0), \quad (3)$$

wherein Voled(0) is a turn-on voltage of the OLED 51.

In the light emitting stage, the driving transistor 50, second transistor 58 and OLED 51 are in on state, and the first transistor 57 is in off state. The anode 511 and the first terminal 551 of the coupling capacitor 55 are both the voltage Voled of the OLED 51, and the coupling capacitor 55 couples the voltage Voled of the OLED 51 to the second node 502:

$$V_G = Vdata + (Voled - (Vref * (1 - f1) + Vdata * f1 - Vt)) = (Vdata - Vref) * (1 - f1) + Vt + Voled, \quad (4)$$

while the voltage difference between the second node 502 and the anode 511 is:

$$V_{GS} = (Vdata - Vref) * (1 - f1) + Vt, \quad (5)$$

so that the output current $I_{oled}$ of the driving transistor 50 can be expressed as:

$$I_{oled} = Kp * (V_{GS} - Vt)^2 = Kp * [(Vdata - Vref) * (1 - f1)]^2, \quad (6)$$

where Kp=½(μ*COX)(W/L), μ is carrier mobility of the driving transistor 50, COX is a per area capacitance of the driving transistor, and (W/L) is a width to length ratio of the driving transistor 50. From equation (6), it can be known that the output current of the driving transistor 50 is not related with the threshold voltage Vt and the voltage of the OLED 51 ($V_{oled}$), thereby not only compensating the threshold voltage of the transistor and the voltage of the AMOLED, but also satisfying the requirements of high precision and high aspect ratio.

It is noted that, in the light emitting stage, there are charges distributed into the first terminal 551 of the coupling capacitor 55 and the third node 503 due to the second transistor 58 being turned on instantaneously. In the moment of turning on the second transistor 58, the first terminal 551 of the coupling capacitor 55 can be expressed as:

$$V_N = \{V_{N_pro} * Cst + V_{S_pro} * Coled\}/(Cst + Coled), \quad (7)$$

where Coled is a capacitance value of the OLED 51, $V_{N_pro}$ is the voltage of the first terminal 551 of the coupling capacitor 55 in the program stage (i.e. Vref*(1−f1)+Vdata*f1−Vt), and $V_{S_pro}$ is the voltage of the third node 503 in the program stage. If the capacitance value can be ignored (i.e. the Coled is much smaller than the capacitance value of the storage capacitor 56 (Cst)), the equation (7) can be simplified as:

$$V_N = Vref * (1 - f1) + Vdata * f1 - Vt. \quad (8)$$

It is thus known that the voltage of the first terminal 551 of the coupling capacitor 55 is maintained to be unchanged, i.e., it still stores the threshold voltage Vt and the voltage of the OLED 51 (Voled). However, if the capacitance value Coled cannot be ignored, the stored threshold voltage Vt of the first terminal 551 of the coupling capacitor 55 may be lost due to the charges distributed between it and the third node 503.

Figure 7:
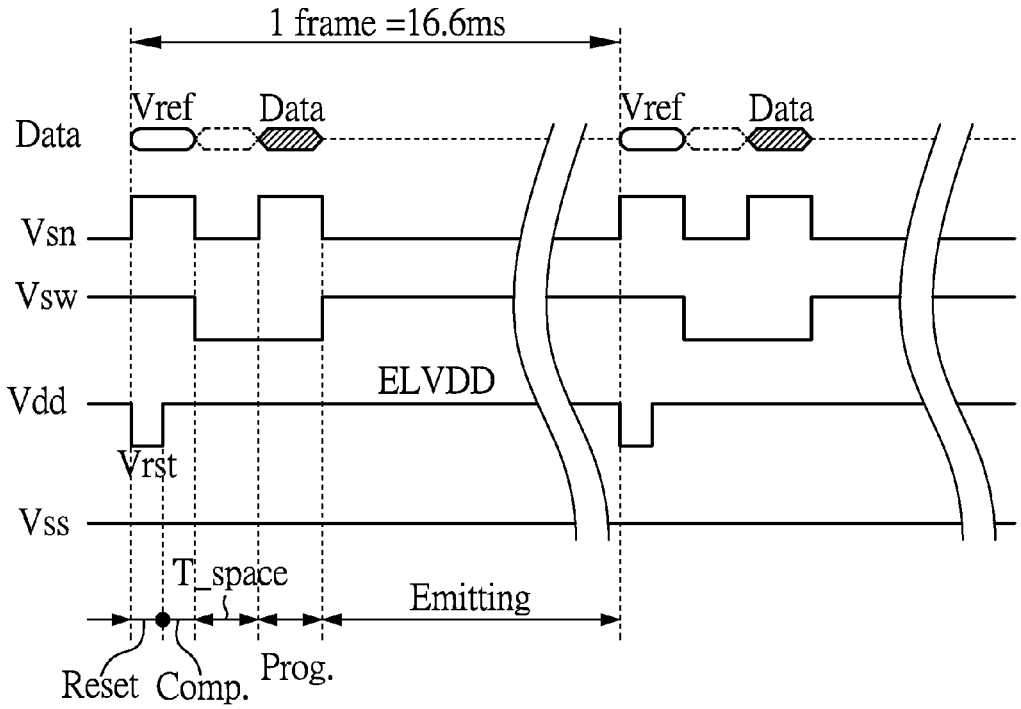
FIG. 7 is another timing diagram of the pixel circuit shown in FIG. 5.

With reference to both FIG. 5 and FIG. 7, FIG. 7 is another timing diagram of the pixel circuit shown in FIG. 5. The timing diagram of FIG. 7 is similar to that of FIG. 6 except that, in the programming stage, the second voltage is the high potential voltage ELVDD and the driving transistor 50 is not reset. The timing diagram shown in FIG. 7 is preferred to be used in the situation that the capacitor Coled of the OLED 51 cannot be ignored (i.e., Coled is not much smaller than the capacitance value Cst of the storage capacitor 56). In the programming stage, the third node 503 is reset to Vdata−Vt. In the moment of turning on the second transistor 58, the voltage $V_N$ of the first terminal 551 of the coupling capacitor 55 is transited as:

$$\begin{aligned} V_N &= \{[Vref*(1-f1)+Vdata*f1-Vt]*Cst+ \\ &\quad [Vdata-Vt]*Coled\}/(Cst+Coled) \\ &= \{[Vref*(1-f1)+Vdata*f1]*Cst+(Vdata*Coled)\}/ \\ &\quad (Cst+Coled)-Vt \\ &= Func(Vref, Vdata, Ccp, Cst, Coled)-Vt, \end{aligned} \tag{9}$$

where Func(Vref, Vdata, Ccp, Cst, Coled) is a function of Vref, Vdata, Ccp, Cst and Coled. From equation (9), it can be known that, in the moment of turning on the second transistor 58, the threshold voltage stored by the first terminal 551 of the coupling capacitor 55 is not lost. Under the timing diagram shown in FIG. 7, the second node 502 voltage ($V_G$), the anode 511 voltage ($V_S$) of the OLED 51, the voltage ($V_N$) of the first terminal 551 of the coupling capacitor 55, the voltage difference ($V_{GS}$) between the second node 502 and the anode 511, and the voltage difference ($V_{GN}$) between the second node 502 of the driving transistor 50 and the first terminal 551 of the coupling capacitor 55 are illustrated in Table 3.

TABLE 3

| | Reset stage | Comp. stage | Prog. stage | Emitting stage |
|---|---|---|---|---|
| Second node of the driving transistor ($V_G$) | Vref | Vref | Vdata | Func (Vref, Vdata, Ccp, Cst, Coled) + Vt + Voled |
| Anode of the OLED ($V_S$) | Vrst | Vref − Vt | Vdata − Vt | Voled |
| First terminal of the coupled capacitor ($V_N$) | Vrst | Vref − Vt | Vref * (1 − f1) + Vdata * f1 − Vt | Voled |
| Voltage difference between the second node and the anode ($V_{GS}$) | Vref − Vrst | Vt | Vt | Func(Vref, Vdata, Ccp, Cst, Coled) + Vt |
| Voltage difference between the second node and the first terminal of the coupling capacitor ($V_{GN}$) | Vref − Vrst | Vt | (Vdata − Vref) * (1 − f1) + Vt | Func (Vref, Vdata, Ccp, Cst, Coled) + Vt |

The invention also provides a method for driving a pixel circuit. Also with reference to the pixel circuit shown in FIG. 5, the method includes the steps of: (A) in the reset stage, using the first control signal SN to turn on the first transistor 57, and inputting the reference voltage Vref to the driving transistor 50 for resetting the second node 502, the third node 503 and the first terminal 581 of the second transistor 58; (B) in the compensating stage, storing a threshold voltage Vt of the driving transistor 50 to the third node 503 and the storage capacitor 56, and the driving transistor 50 being transited from on state to off state; (C) in a programming stage, using the second control signal SW to turn off the second transistor 58, inputting the data voltage Vdata to the driving transistor 50, and coupling a voltage of the coupling capacitor 55 to the first terminal 551 of the coupling capacitor 55; and (D) in the light emitting stage, coupling the threshold voltage Vt and a voltage Voled of the OLED 51 to the second node 502.

Figure 8:
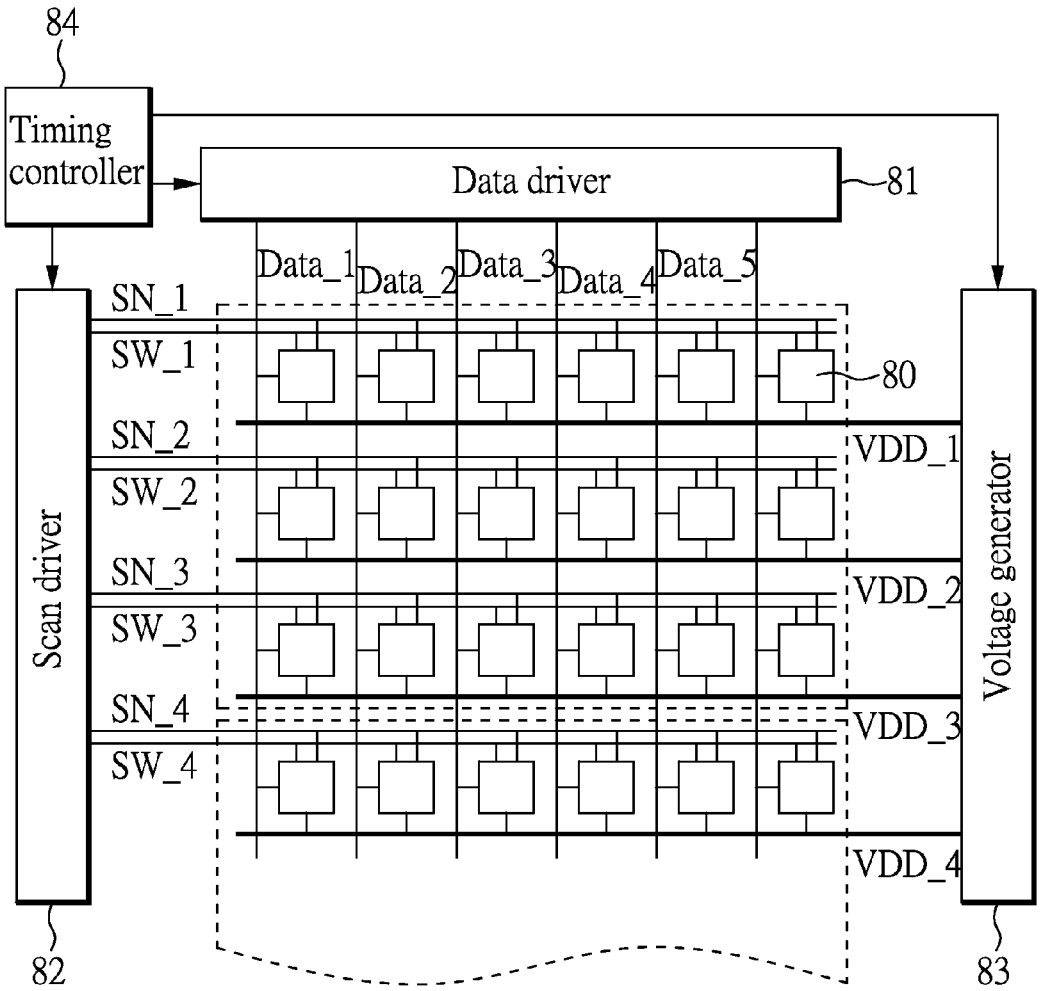
FIG. 8 is a schematic diagram of the display panel in accordance with a preferred embodiment of the invention.

With reference to FIG. 8, there is shown a schematic diagram of the display panel using the aforementioned pixel circuit in accordance with a preferred embodiment of the invention, which includes: a plurality of pixel circuits 80, a data driver 81, a scan driver 82, a voltage generator 83, and a timing controller 84. The pixel circuits 80 are arranged as a pixel circuit matrix according a plurality of columns and rows. The data driver 81 has a plurality of data driving lines (Data_1, Data_2, Data_3, . . . ) connected to the pixel circuits 80 on the columns of the pixel circuit matrix for providing at least an input voltage. The scan driver 82 has a plurality of scan driving lines (SN_1, SW_1, SN_2, SW_2, SN_3, SW_3, . . . ) vertically intersected with the data driving lines for being connected to the pixel circuits on the rows of the pixel circuit matrix for providing at least a switching voltage. The voltage generator has a plurality of voltage supply lines respectively arranged between the scan driving lines for being connected to the pixel circuits so as to supply at least a voltage source. The timing controller 84 is connected to the data driver 81, the scan driver 82, and the voltage generator 83, respectively, for controlling the data driver 81, the scan driver 82, and the voltage generator 83. In one embodiment, the display panel configures three rows of the pixel circuit matrix as a display unit. The reset stage, compensation stage, programing stage and light emitting stage of each display unit are executed sequentially, and the display units are performed sequentially.

Figure 9:
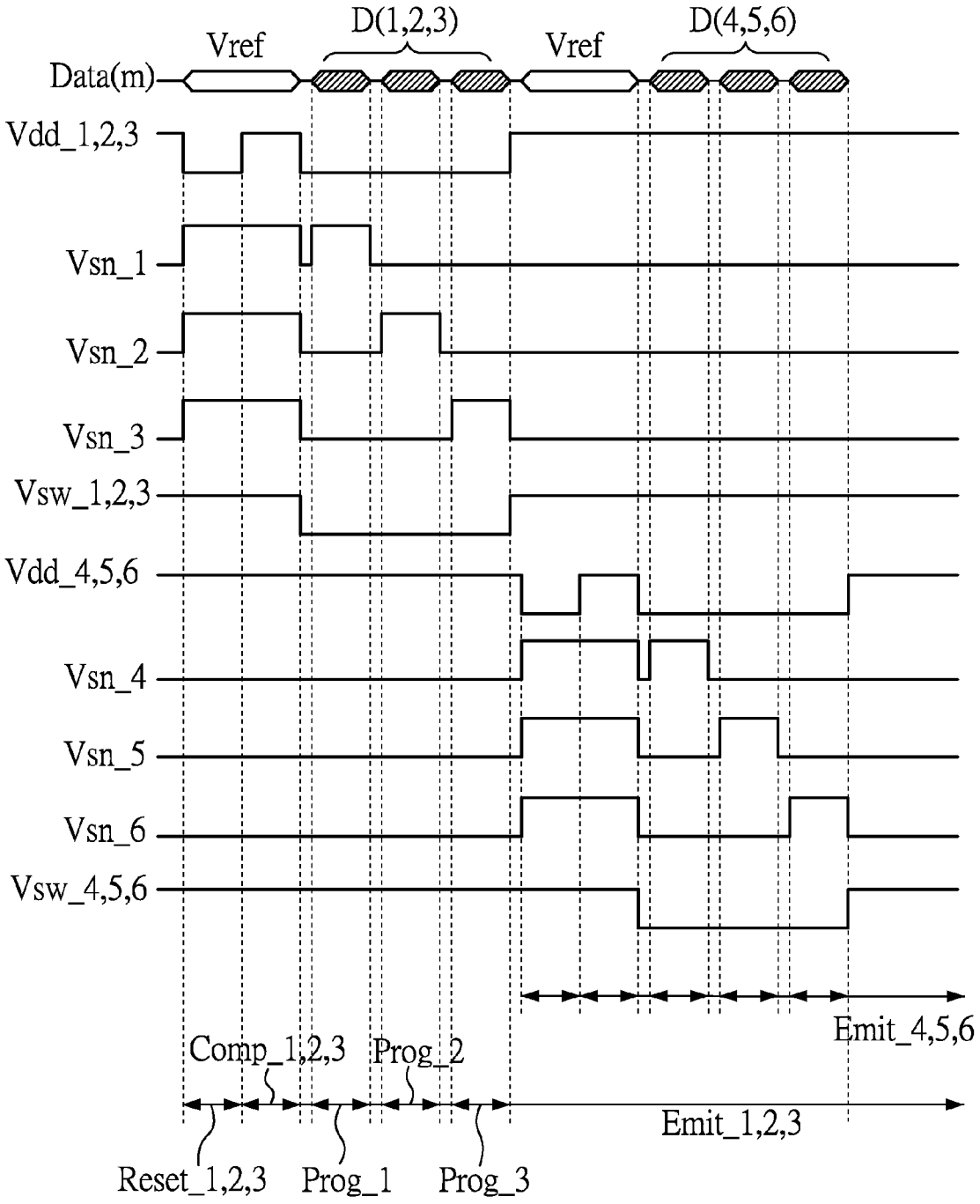
FIG. 9 is a timing diagram for the display panel using three rows of the pixel circuit matrix as a display unit in accordance with the invention.

With reference to FIG. 9, there is shown a timing diagram for the display panel using three rows of the pixel circuit matrix, shown in FIG. 8, as a display unit in accordance with the invention. The embodiment shown in FIG. 9 is similar to that in FIG. 6 except that, in the programming stage, the scan driver 82 sequentially turns on the first transistors 57 of the pixel circuits 80 of each row for the display unit via the scan driving lines (SN_1, SN_2, SN_3) and, at the same time, the data driving line Data(m) inputs a set of data voltage Vdata (1,2,3). The set of data voltage Vdata(1,2,3) sequentially inputs a data voltage to the first transistors 57 of the pixel circuits 80 of each column. The set of data voltage Vdata(1, 2,3) sequentially inputs a data voltage to the first transistors 57 of the pixel circuits 80 of each column, corresponding to the scan driving lines (SN_1, SN_2, SN_3) sequentially turning on the first transistors 57 of the pixel circuits 80 of each row. The remaining is operated in the same manner. When the display unit completes the reset stage, the compensation stage, the programming stage and the light emitting stage, the next display unit is then performed sequentially.

Figure 10:
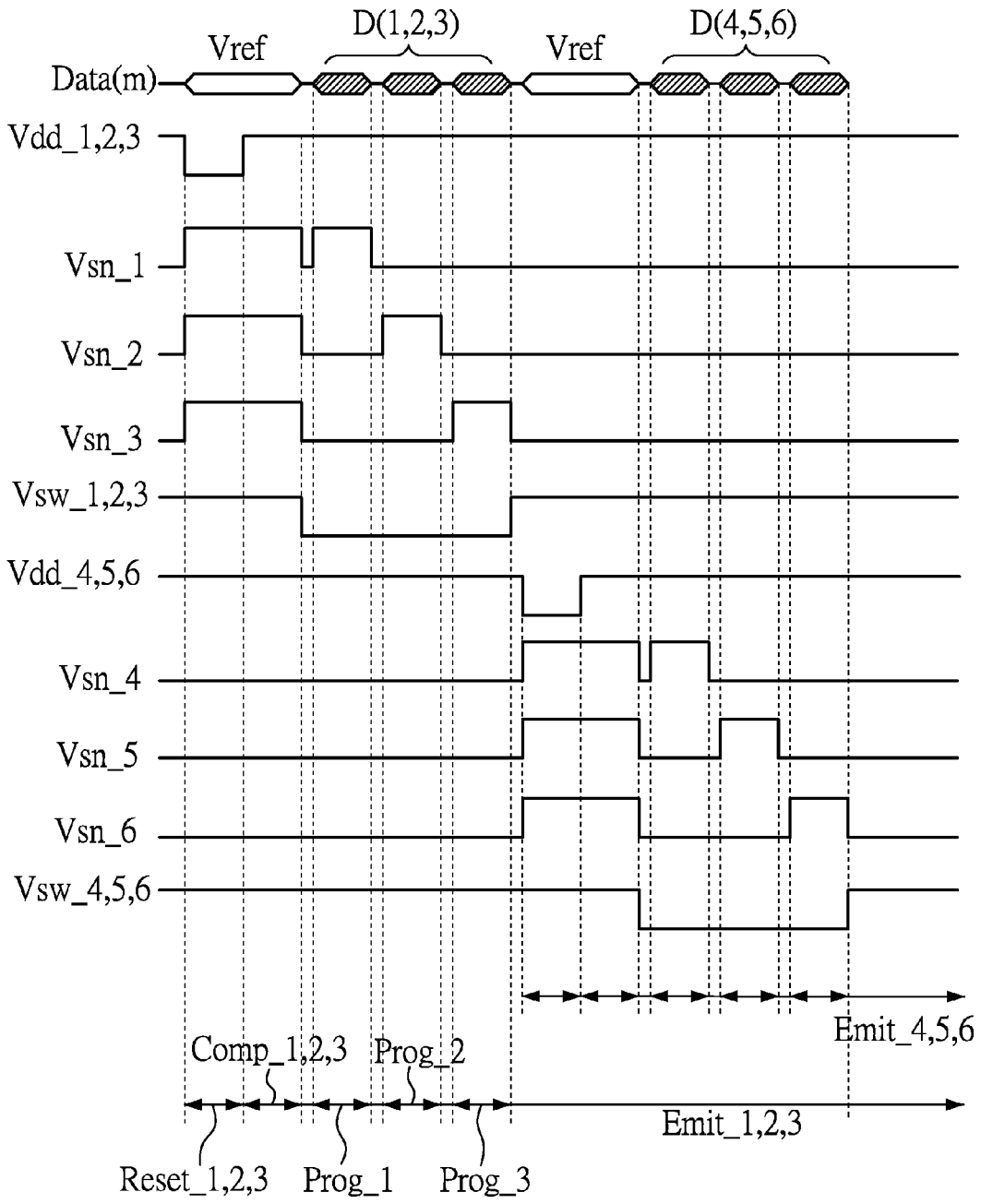
FIG. 10 is another timing diagram for the display panel using three rows of the pixel circuit as a display unit in accordance with the invention.

With reference to both FIG. 8 and FIG. 10, FIG. 10 is another timing diagram for the display panel using three rows of the pixel circuit matrix, shown in FIG. 8, as a display unit in accordance with the invention. As shown in FIG. 10, this embodiment is similar to that in FIG. 7 except that, in programming stage, the scan driver 82 sequentially turns on the first transistors 57 of the pixel circuits 80 of each of three rows for the pixel circuit matrix via the scan driving lines (SN_1, SN_2, SN_3) and, at the same time, the data driving line Data(m) inputs a set of data voltage Vdata(1,2,3). The set of data voltage Vdata(1,2,3) sequentially inputs a data voltage to the first transistors 57 of the pixel circuits 80 of each row. The set of data voltage Vdata(1,2,3) sequentially inputs a data voltage to the first transistors 57 of the pixel circuits 80 of each row corresponding to the scan driving lines (SN_1, SN_2, SN_3) sequentially turning on the first transistors 57 of the pixel circuits 80 of each row. The remaining is operated in the same manner. This embodiment is different from FIG. 9 only in that, in the programming stage, the second voltage Vdd_1,2,3 provided by the voltage supply lines of the voltage generator 83 is maintained at a high voltage ELVDD and the driving transistor 50 is not reset, while the remaining is the same.

Figure 11:
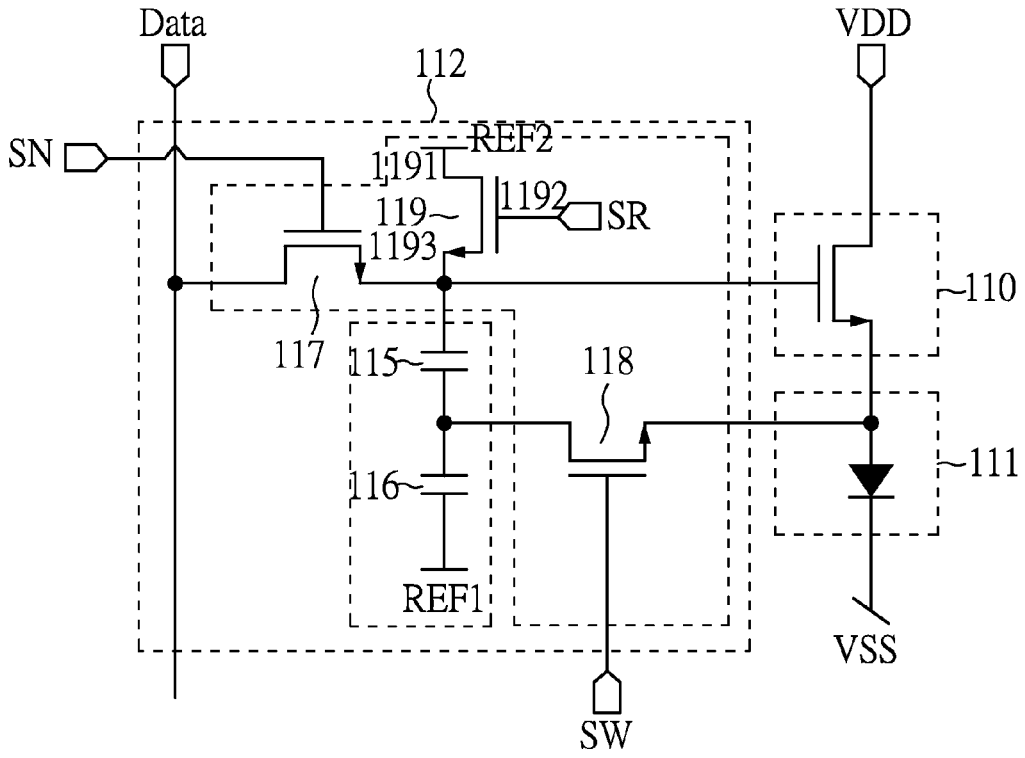
FIG. 11 is a schematic diagram of the pixel circuit in accordance with another preferred embodiment of the invention.
Figure 12:
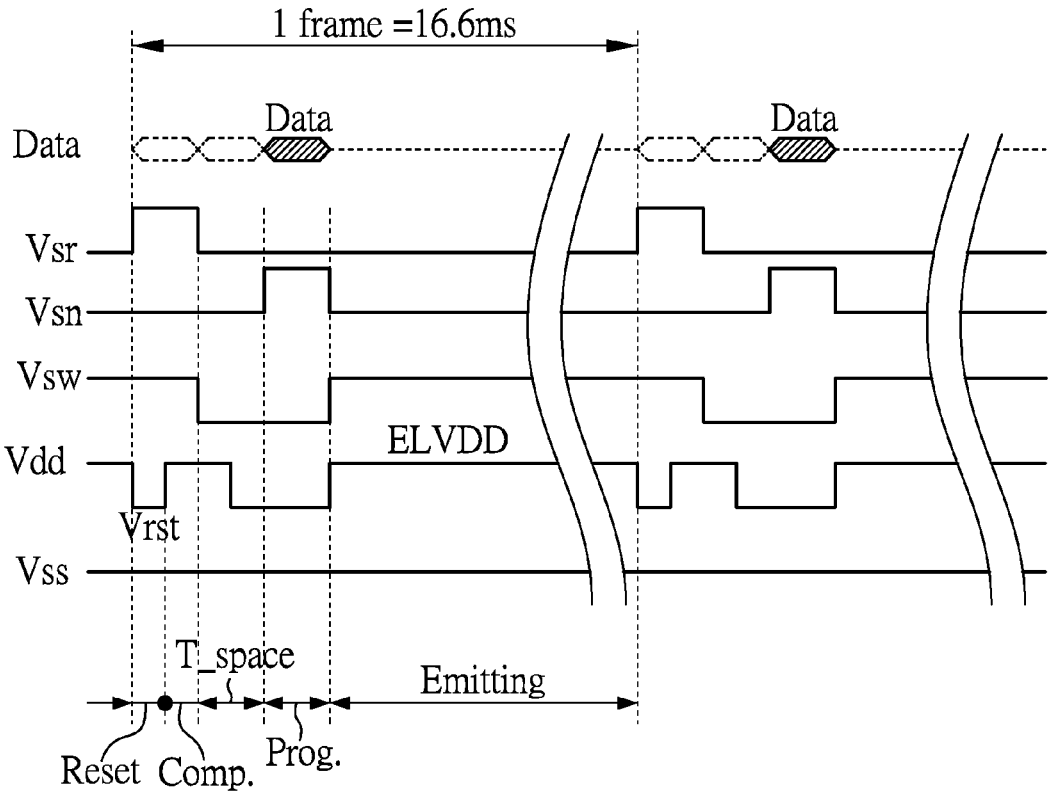
FIG. 12 is a timing diagram of the pixel circuit shown in FIG. 11.

With reference to FIG. 11, there is shown a schematic diagram of the pixel circuit in accordance with another preferred embodiment of the invention. This embodiment is different from FIG. 5 only in that a third transistor 119 is added. The third transistor 119 has a first terminal 1191 connected to a fourth voltage source REF2, a second terminal 1192 connected to a third control signal source SR that provides a third control signal Vsr, and a third terminal 1193 connected to the second node 502, wherein the fourth voltage source REF2 is used to provide the reference voltage Vref. Please also refer to FIG. 12, which is a timing diagram of the pixel circuit shown in FIG. 11. It is proposed to reduce the turn-on frequency of the first control signal Vsn in FIG. 6, and to turn on the third transistor 119 by the third control signal Vsr so as to input the reference voltage Vref, while the remaining is the same.

Figure 13:
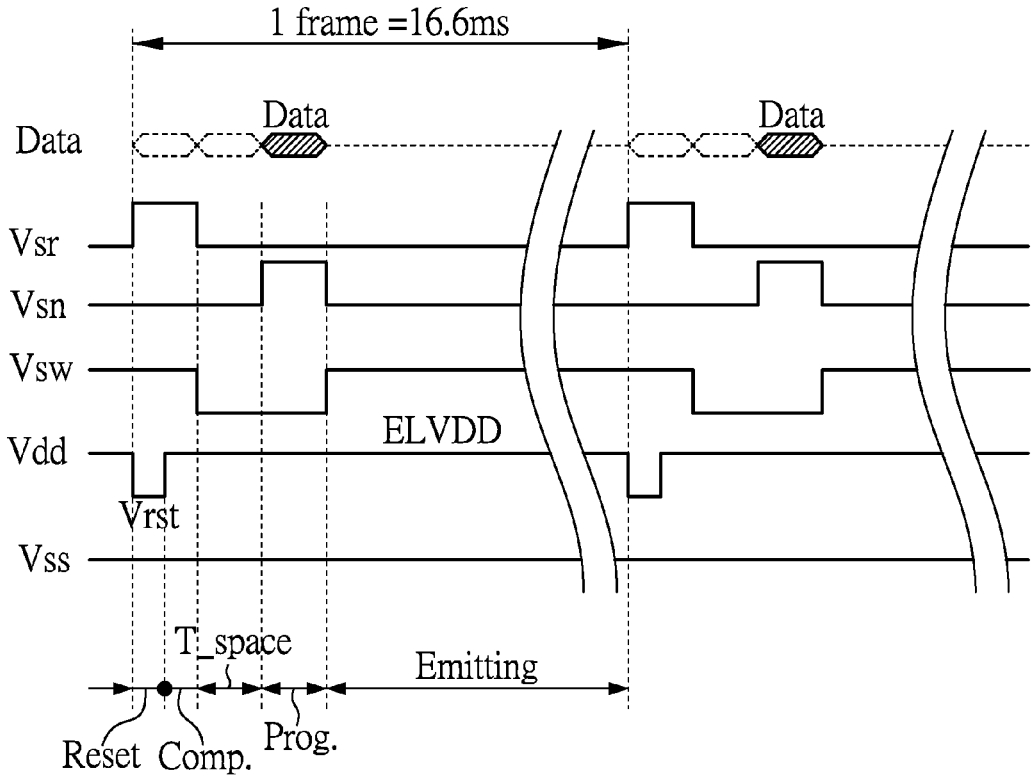
FIG. 13 is another timing diagram of the pixel circuit shown in FIG. 11.

With reference to both FIG. 11 and FIG. 13, FIG. 13 is another timing diagram of the pixel circuit shown in FIG. 11. As shown in FIG. 13, this embodiment is different from FIG. 7 only in that the turn-on frequency of the first control signal Vsn in FIG. 7 is decreased, and the third transistor 119 is turned on by the third control signal Vsr so as to input the reference voltage Vref, while the remaining is the same. Further, this embodiment is different from FIG. 12 only in that, in the programming stage, the second voltage Vdd provided by the voltage supply lines of the voltage generator 83 is maintained at a high voltage ELVDD and the driving transistor 50 is not reset, while the remaining is the same.

Although the present invention has been explained in relation to its preferred embodiment, it is to be understood that many other possible modifications and variations can be made without departing from the spirit and scope of the invention as hereinafter claimed.

What is claimed is:

1. A pixel circuit, comprising:

an OLED including an anode, and a cathode connected to a first voltage source;

a driving transistor for driving the OLED, the driving transistor including a first node connected to a second voltage source, a second node, and a third node connected to the anode;

a first transistor including a first terminal connected to a data driving line, a second terminal connected to a first control signal source, and a third terminal connected to the second node;

a second transistor including a first terminal, a second terminal connected to a second control signal source, and a third terminal connected to the anode and the third node;

a storage capacitor including a first terminal directly connected to a third voltage source and a second terminal directly connected to the first terminal of the second transistor; and a coupling capacitor including a first terminal directly connected to the first terminal of the second transistor and a second terminal directly connected to the second node;

wherein, in a compensating stage, a voltage of the second voltage source is applied to the driving transistor, and the voltages of the second voltage source are switched between two voltage levels in a reset, the compensating, and a programming stages.

2. The pixel circuit as claimed in claim 1, wherein, in the reset stage, the first control signal source provides a first control signal to turn on the first transistor, and the data driving line inputs a reference voltage to the driving transistor for resetting the second node, the third node and the first terminal of the coupling capacitor; in the compensating stage, the third node and the storage capacitor store a threshold voltage of the driving transistor, and the driving transistor transits from on state to off state; in the programming stage, the second control signal source provides a second control signal to turn off the second transistor, the data driving line inputs a data voltage to the driving transistor, and a voltage of the coupling capacitor is coupled to the first terminal of the coupling capacitor; in a light emitting stage, the threshold voltage and a voltage of the OLED are coupled to the second node.

3. The pixel circuit as claimed in claim 1, wherein the driving transistor, the first transistor and the second transistor are N-type transistors.

4. The pixel circuit as claimed in claim 1 further comprising a third transistor including a first terminal connected to a fourth voltage source, a second terminal connected to a third control signal source, and a third terminal connected to the second node, the fourth voltage source providing a reference voltage, the third transistor being turned on according to a third control signal so as to input the reference voltage to the second node.

5. A method for driving a pixel circuit, the pixel circuit comprising an OLED including an anode, and a cathode connected to a first voltage source; a driving transistor for driving the OLED, the driving transistor including a first node connected to a second voltage source which provides a second voltage, a second node and a third node connected to the anode; a first transistor including a first terminal connected to a data driving line, a second terminal connected to a first control signal source and a third terminal connected to the second node; a second transistor including a first terminal, a second terminal connected to a second control signal source and a third terminal connected to the anode and the third node; a storage capacitor including a first terminal directly connected to a third voltage source and a second terminal directly connected to the first terminal of the second transistor; and a coupling capacitor including a first terminal directly connected to the first terminal of the second transistor and a second terminal directly connected to the second node, the method comprising the steps of:

(A) in a reset stage, using the first control signal to turn on the first transistor, and inputting a reference voltage to the driving transistor for resetting the second node, the third node and the first terminal of the coupling capacitor;

(B) in a compensating stage, storing a threshold voltage of the driving transistor to the third node and the storage capacitor, and the driving transistor being transited from on state to off state;

(C) in a programming stage, using the second control signal to turn off the second transistor, inputting a data voltage to the driving transistor, and coupling a voltage of the coupling capacitor to the first terminal of the coupling capacitor; and (D) in a light emitting stage, coupling the threshold voltage and a voltage of the OLED to the second node;

wherein, the voltages of the second voltage source are switched between two voltage levels in the reset, the compensating, and the programming stages.

6. The method as claimed in claim 5, wherein, in step (A), the second voltage is a first reset voltage, and the reference voltage is greater than a sum of the first reset voltage and a threshold voltage.

7. The method as claimed in claim 5, wherein, in step (C), the second voltage is a second reset voltage, and the second reset voltage is lower than or equal to a sum of the first voltage and an initial voltage of the OLED.

8. The method as claimed in claim 5, wherein the driving transistor, the first transistor and the second transistor are N-type transistors.

9. The method as claimed in claim 5, wherein the pixel circuit further comprising a third transistor including a first terminal connected to a fourth voltage source, a second terminal connected to a third control signal source, and a third terminal connected to the second node, the third control signal source providing a third control signal, the fourth voltage source providing the reference voltage, so that, in step (A), the third transistor is turned on according to a third control signal so as to input the reference voltage to the second node.

10. A display panel, comprising:

a plurality of pixel circuits arranged as a pixel circuit matrix according a plurality of columns and rows;

a data driver having a plurality of data driving lines connected to the pixel circuits on the columns of the pixel circuit matrix for providing at least an input voltage;

a scan driver having a plurality of scan driving lines vertically intersected with the data driving lines for being connected to the pixel circuits on the rows of the pixel circuit matrix for providing at least a switching voltage;

a voltage generator having a plurality of voltage supply lines respectively arranged between the scan driving lines for being connected to the pixel circuits to supply at least a voltage source;

a timing controller connected to the data driver, the scan driver, and the voltage generator for controlling the data driver, the scan driver, and the voltage generator, wherein each of the pixel circuits comprises:

an OLED including an anode, and a cathode connected to a first voltage source;

a driving transistor for driving the OLED, the driving transistor including a first node connected to a second voltage source, a second node, and a third node connected to the anode;

a first transistor including a first terminal connected to a data driving line, a second terminal connected to a first control signal source and a third terminal connected to the second node;

a second transistor including a first terminal, a second terminal connected to a second control signal source and a third terminal connected to the anode and the third node;

a storage capacitor including a first terminal directly connected to a third voltage source and a second terminal directly connected to the first terminal of the second transistor; and a coupling capacitor including a first terminal directly connected to the first terminal of the second transistor and a second terminal directly connected to the second node;

wherein, in a compensating stage, a voltage of the second voltage source is applied to the driving transistor, and the voltages of the second voltage source are switched between two voltage levels in a reset, the compensating, and a programming stages.

11. A pixel circuit, comprising:

an OLED including an anode, and a cathode directly connected to a first voltage source;

a driving transistor for driving the OLED, the driving transistor including a first node directly connected to a second voltage source, a second node, and a third node directly connected to the anode;

a first transistor including a first terminal directly connected to a data driving line, a second terminal directly connected to a first control signal source, and a third terminal connected to the second node;

a second transistor including a first terminal, a second terminal directly connected to a second control signal source, and a third terminal connected to the anode and the third node;

a storage capacitor including a first terminal directly connected to a third voltage source and a second terminal directly connected to the first terminal of the second transistor; and a coupling capacitor including a first terminal directly connected to the first terminal of the second transistor and a second terminal directly connected to the second node.

* * * * *